United States Patent [19]

Haldemann et al.

[11] Patent Number: 4,735,845

[45] Date of Patent: Apr. 5, 1988

[54] SAFETY BINDING OF A BOOT ON A SKI

[75] Inventors: Gaston Haldemann, Furigen; Francois Wirz, Saviese, both of Switzerland

[73] Assignee: Haldemann AG, Stans, Switzerland

[21] Appl. No.: 774,537

[22] Filed: Sep. 10, 1985

[30] Foreign Application Priority Data

Oct. 19, 1984 [CH] Switzerland ..... 5026/84

[51] Int. Cl.[4] ..... A63C 9/08

[52] U.S. Cl. ..... 428/156; 280/624

[58] Field of Search ..... 428/156, 613, 624, 625, 428/629, 616, 634; 292/48, 196

[56] References Cited

U.S. PATENT DOCUMENTS 4,522,423 6/1985 Haldemann et al. .
4,536,006 8/1985 Haldemann et al. .

FOREIGN PATENT DOCUMENTS 84813 8/1983 European Pat. Off. .
85313 8/1983 European Pat. Off. .
111886 6/1984 European Pat. Off. .
139815 5/1985 European Pat. Off. .
1411638 8/1965 France .
2021237 7/1970 France .
2089540 1/1972 France .
2159480 6/1973 France .
2420358 10/1979 France .
462668 10/1968 Switzerland .
506304 6/1971 Switzerland .
645030 9/1984 Switzerland .

*Primary Examiner*—Nancy A. B. Swisher
*Attorney, Agent, or Firm*—Young & Thompson

[57] ABSTRACT

A safety binding of a boot on a ski, which comprises two lateral clamps (1) displaceably mounted under the effect of a resilient member between a closed service position, in which the clamps cooperate with the sole of the boot, and an open position. Each lateral clamp is pivoted at the end of an arm (12) on a pivot axle (14) perpendicular to the plan of the ski, said arm being itself pivotaly mounted by its other end on an axle (13) perpendicular to said plan of the ski.

7 Claims, 4 Drawing Sheets

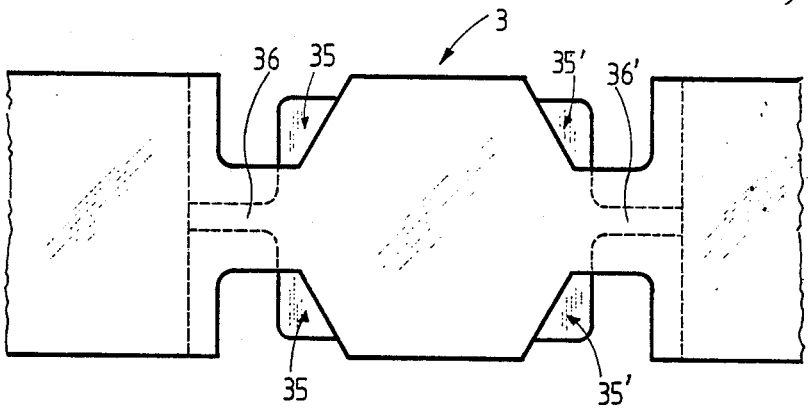
FIG. 11
FIG. 12
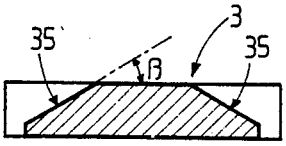
FIG. 13
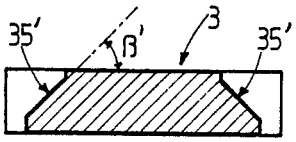
FIG. 14
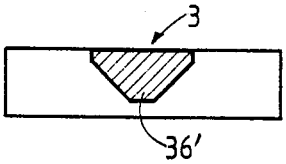
FIG. 15
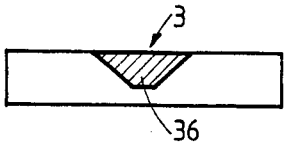

SAFETY BINDING OF A BOOT ON A SKI

The present invention relates to a safety binding of a boot on a ski, and more particularly to a safety binding comprising lateral clamps adapted to maintain in operative position the boot on a ski, as well as to a boot adapted to cooperate with said binding.

The principle of bindings with lateral clamps has been known for a number of years, especially from FR Pat. Nos. 1.411.638 and 2.021.237, but has not until the present been sufficiently satisfactorily and safely embodied to be successfully commercialized. Improvments has been made for example to improve the disengagement of the boot when opening the safety binding, as described in FR Pat. No. 2.420.358, or to improve the working itself of this type of binding and to give it a greater reliability in case of fall, as disclosed in CH Pat. No. 645.030 and in the published European patent application Nos. 0.084 813 and 0 085 313.

The bindings with lateral clamps in general and those of the type described in the last two documents cited above in particular have the following further drawbacks. The lateral clamps comprise slope or wedge shapes corresponding to a shaped portion provided in the sole of the boot or attached thereto. These shapes are three dimensions since they are adapted to maintain the boot laterally, longitudinally and vertically. These shapes are thus complicated and necessitate a very high precision.

Furthermore, the short clamping length in such bindings between the lateral clamps and the shaped portion with regard to the length of the boot is a serious drawback. As a matter of fact, lack of precision of some tenths of mm in the clamping shapes of the clamps or of the shaped portion will lead to clearances of several mm at the ends of the boot, this making the binding hardly usable practically. That is why, with such systems, the use of a shaped portion directly obtained from plastic moulding is practically impossible, since with the tolerances of said plastic moulding the necessary precision cannot be guaranteed.

Furthermore, the introduction of snow, ice or other elements such as gravel between the sole of the boot and the upper plate of the binding modifies the clamping geometrical shapes and causes very important clearances at the ends of the boot, this leading to a practical use which is not satisfactory and not reliable.

The purpose of the present invention is thus to remedy the precited drawbacks of the known bindings with lateral clamps, so as to guarantee the clamping stability of the boot on the binding under all the unfavorable conditions, that is even when external elements, such as snow, ice or gravel, are present between the boot and the binding, this thanks to a self compensation of the clearances, which allows also to increase to a very important extent the clamping length and to guarantee thus a better stability.

The safety binding according to the invention achieves the above purpose and comprises two lateral clamps which are movably mounted under the action of a resilient member between a closed service position, in which these clamps cooperate with the sole of the boot, and an opened position, characterized by the fact that each lateral clamp is articulated at the end of an arm on a pivot which is perpendicular to the plane of the ski, said arm being itself pivotaly mounted by its other end on an axis which is perpendicular to said plane of the ski.

According to a prefered embodiment, each clamp comprises a fore gripping finger and a rear gripping finger, these fingers making with the plane of the ski an angle comprised between 20° and 35° for the fore finger and between 40° and 50° for the rear finger.

A second object of this invention is the provision of a boot adapted to be fixed on a ski by means of the safety binding defined above, and which is characterized by the fact that it comprises a sole whose medial portion has presenting shapes having on each side two gripping formations adapted to co-act in service position with the lateral clamps of the binding, a first fore gripping formation presenting a face inclined inwardly and upwardly and making with the plane of the sole an angle comprised between 20° and 35°, and a second rear gripping formation presenting a face inclined inwardly and upwardly and making with the plan of the sole, an angle comprised between 40° and 50°.

The accompanying drawings illustrate the invention schematically and by way of example.

FIG. 11 is a plan view of the sole of a ski-boot according to FIG. 10.

FIGS. 12 to 15 are cross-section views along lines XII—XII, XIII—XIII, XIV—XIV and XV—XV respectively of FIG. 10.

Figure 1:
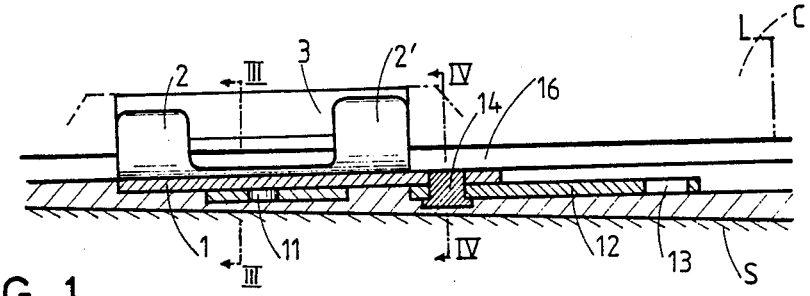
FIGS. 1 and 2 are respectively a side view partly in cross-section and a plan view of the lateral clamps of the binding, in closed service position and under normal conditions.
Figure 2:
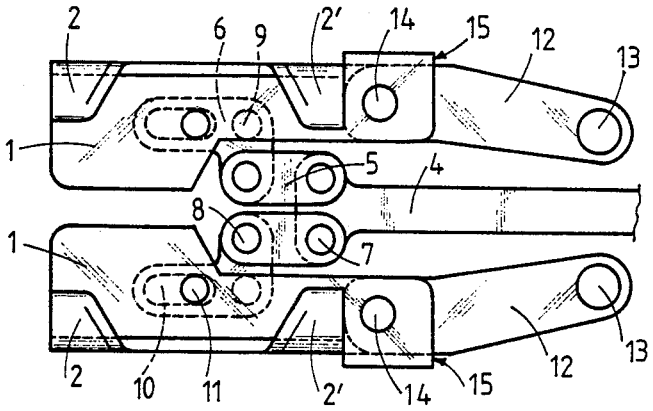
Figure 3:
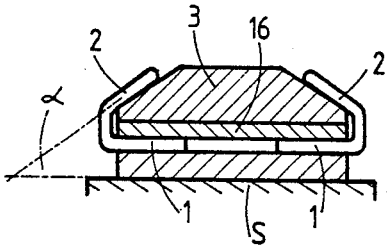
FIGS. 3 and 4 are cross-section views along lines III—III and IV—IV respectively of FIG. 1.
Figure 4:
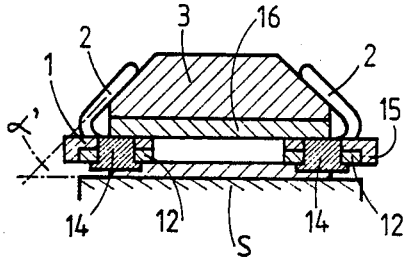
Figure 5:
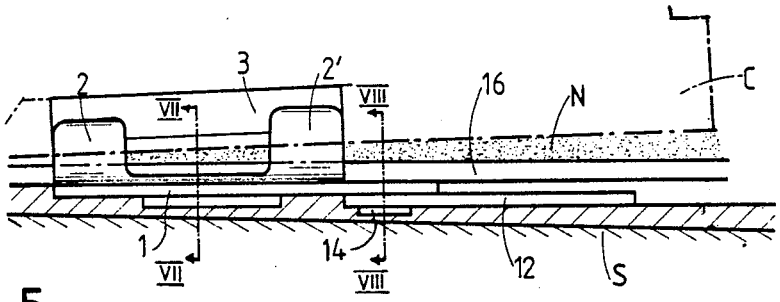
FIGS. 5 and 6 are respectively a side view partly in cross-section and a plan view of the clamps, in closed service position, and in the presence of an over-thickness of snow or ice.
Figure 6:
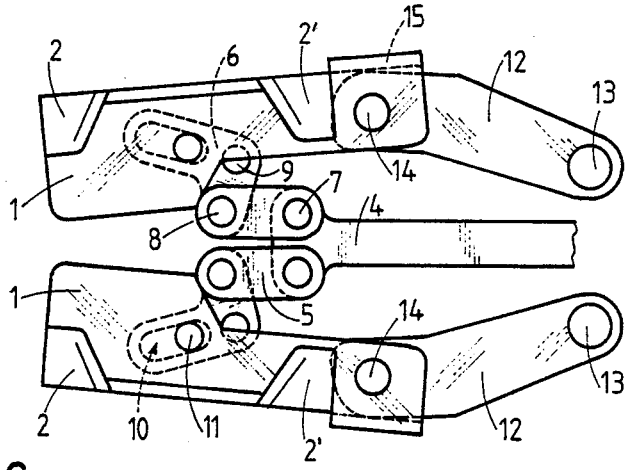
Figure 7:
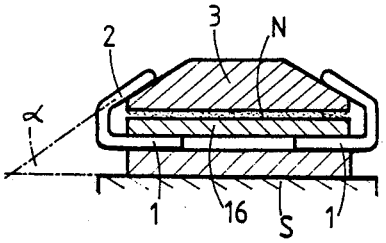
FIGS. 7 and 8 are cross-section views along lines VII—VII and VIII—VIII respectively of FIG. 4.
Figure 8:
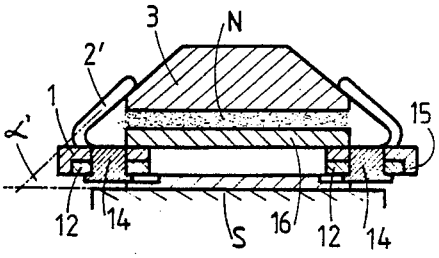

With reference first to FIGS. 1 to 3, the embodiment of the invention as partly shown is a safety binding fixed on the upper surface of a ski S and comprising two lateral clamps 1. In closed service position, the lateral clamps 1 clasp by their respective fore gripping members 2 and rear gripping members 2', the lateral edges of the medial portion 3 of the sole of a ski-boot C, more particularly the corresponding shaped formations presented by these lateral edges. As shown, the fore gripping members or fingers 2 make with the plane of the ski an angle $\alpha$ of about 30°, whereas the rear gripping fingers 2' make with said plane an angle $\alpha$ of about 45°.

In the open position (not shown), the lateral clamps 1 no longer maintain between them the medial portion 3 of the sole of the boot C. The displacement between the two positions respectively closed and opened described above is caused by the action of an energy storage resilient member (not shown) preferably located behind the clamps 1, and by means for example of a longitudinally sliding strip 4.

The front end of this actuating strip 4, whose other end cooperates with the resilient member, is connected with the clamps 1 by means of two pairs of rods 5,6. Each pair of rods comprises a first straight rod 5 pivoted at one end on the end of the strip 4 and at the other end on a second elbowed rod 6, by means of articulation pins 7, 8. Said second rod is pivotally mounted by its elbowed portion on a vertical axle 9 fixed to the upper surface of the ski S and presenting an elongated opening 10 with which an articulation pin 11 cooperates, said pin being fixed on the horizontal part of the clamp 1, so as to allow the lateral opening of said clamp under the action of a forward translation motion of the strip 4. This motion is possible by the fact that each clamp 1 is carried by an arm 12 whose rear end is pivotaly mounted on a vertical pin 13.

More particularly each clamp 1 is articulated on an arm 12 by means of a vertical articulation pin 14; the pivoting of the clamp 1 at the end of the arm 12 is further limited by a shoulder 15 presented by said clamp at its rear end, said shoulder 15 coming into abutment against the arm 12 in the opened position of the binding, and this after the taking up of the working clearance.

FIGS. 4 to 7 illustrate the same binding as that of FIGS. 1 to 3, but in the case where a layer of snow N, of ice or of any other materials (earth, gravel, etc.) was introduced during the clamping of the binding between the base plate 16 thereof and the sole of the boot C. This undesired thickness of snow N tends to lift by several millimeters the boot C, in such a manner that the rear gripping members 2' of the clamps 1 are slightly moved apart toward the outside by the slope presented by the medial portion 3 of the sole of the boot, this causing the pivoting of the clamps 1 on the arm 12, and a displacement toward the outside of the articulation pins 14, the clamps 1 forming thus with the arms 12 an obtuse angle.

Thus, even in presence of an undesired thickness of snow N under the boot C, the gripping members 2, 2' of the lateral clamps 1 remain always in contact with the corresponding shaped parts of the medial portion 3 of the sole of the boot C, and the fixation thereof on the ski S is therefore also secured in the precited situation. The quality of the clamping and of the centering of the gripping members on the shaped portion is thus independent of the presence of external elements and of the location thereof.

The invention applies of course to any binding of the above type described with reference to the accompanying drawings, whichever the mechanical system that is used to control the opening and the closing of the lateral clamps. It applies especially well to the bindings which are described in the former documents of the same inventors mentioned in the introduction of this specification.

More particularly, the actuating mechanical system may comprise a strip such as that illustrated in the accompanying drawings, that slides longitudinally, and the front end of which is connected to the lateral clamps by means of two pairs of rods, and whose other end coacts with a crank subjected to the action of a resilient member, so that this crank has two stable positions corresponding to the respective open and closed service positions of the clamps.

Figure 9:
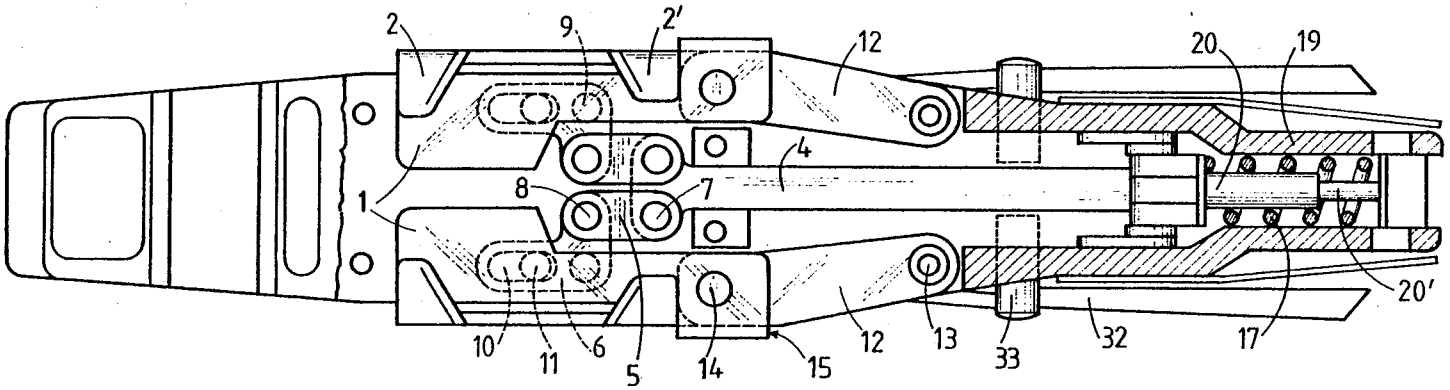
FIGS. 9 and 10 are views respectively from above and from the side, partly in cross-section, of a complete embodiment of the safety binding with heel means, FIG. 10 illustrating a boot according to the invention fastened in service position by this binding.
Figure 10:
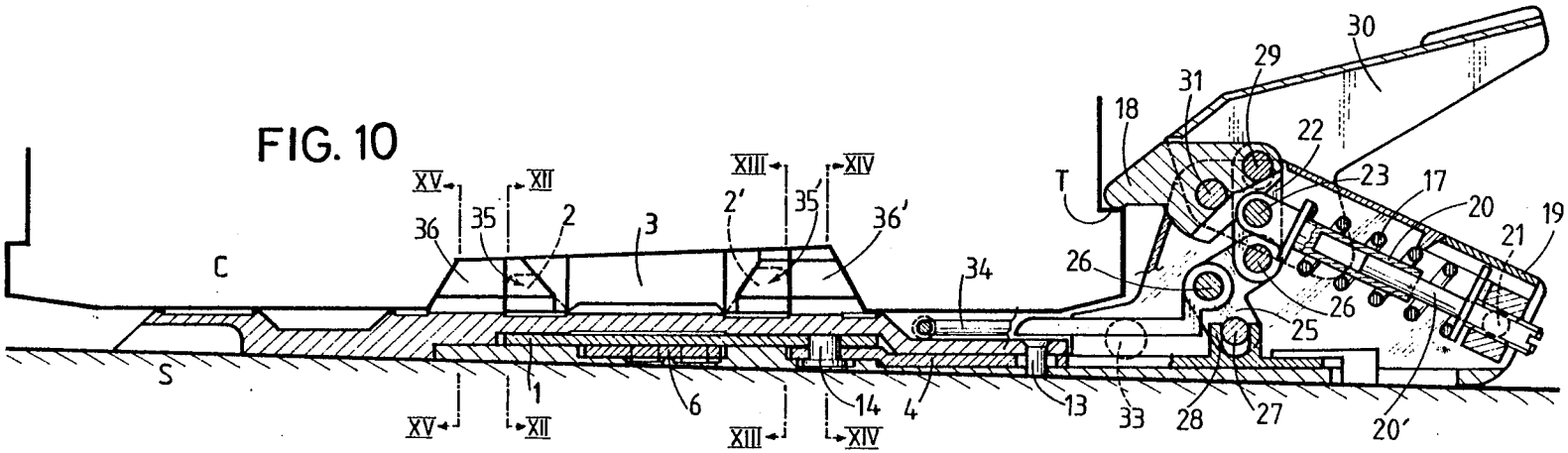

Such a system is shown in FIGS. 9 and 10, which comprises further a heel means usable as a sole gripping element and the mechanism and the working of which are similar to those described in the published European patent application No. 84.103485.3.

In this embodiment, only one energy storing resilient member, for example constituted by a spring 17, actuates simultaneously the lateral clamps 1 and a sole gripping element 18 which are mechanically coupled the one to the other, here through especially the actuating strip 4, so that the opening or the closing, of one of both devices causes the opening or closing of the other, and vice-et-versa.

The spring 17 is mounted in a housing 19, said housing being fixed on the upper surface of the ski S, and on a telescopic rod or bar formed of two parts, 20,20', sliding the one within the other, said rod 20,20' being pivotally mounted by its rear end on a transverse axis 21 fixed in the wall of the housing 19. The front end of this telescopic bar 20, 20' is articulated in the middle of straight rod 22 (articulation transverse axis 23), said rod being pivoted by its rear end on a transverse axis 24 on which an end of an elbowed rod 25 is also articulated, said elbowed rod serving as "crank" member. This elbowed rod 25 is pivotally mounted by its elbowed portion on a transverse axle 26 fixed in the walls of the housing 19, and co-acts by its other end 27 with a fork 28 which is provided by the rear end of the actuating strip 4. With regard to the other end of the straight rod 22, it is pivoted with clearance on a transverse axle 29 fixed to an actuating lever 30, said lever being pivotally mounted on a transverse axle 31 fixed in the walls of the housing 19, said lever 30 having as its formed portion the sole gripping element 18, bearing in the service position shown on an upper shoulder T of the heel of the ski-boot C. It is further illustrated in FIGS. 9 and 10 on the one hand a "stopper" or brake comprising two arms 32 pivotally mounted on a transverse axle 33 and on the other hand an automatic engagement member 34 ("step-in") actuated by the heel of the ski-boot and co-acting with the "crank" member 25 so as to close the binding.

In the service position illustrated in FIG. 10, the fore gripping fingers 2 and the rear gripping fingers 2' respectively cooperates with corresponding gripping formations 35, 35' which are presented by the shaped portion 3 located in the medial part of the sole of the ski-boot C. The two fore gripping fingers 2, making an angle comprised between 20° and 35° with the plane of the ski, ensure the working of the binding in the case of a rearward disengagement, whereas the rear gripping fingers 2' making with the plane of the ski an angle of 40° to 50°, to ensure the working of the binding in the case of a forward disengagement.

Generally, the clamps and thereby the gripping fingers are subjected to the action of the same and sole tension system. The difference between the angles of the rear and the front fingers, and thereby the difference of angle of the respective corresponding shaped parts of the boot, is absolutely necessary for the good working of the binding. As a matter of fact, the disengagement torque in case of rearward fall should be greater than the disengagement torque in case of a forward fall. It is generally considered that the "rearward fall" torque should be of about 25 to 35% greater than the "forward fall" torque. The gripping effects with the lateral clamps being in the middle of the boot, the angle differences between the front fingers and the rear ones are determined by the torque differences between forward fall and rearward fall, necessary to the good working of the release of the binding.

An opening is provided on the clamps, between the fore fingers 2 and the rear fingers 2', during the working in case of twisting and from the limit of disengagement, the shaped portion 3 of the sole of the boot leaves the fingers and enters the opening, this allowing a complete twisting disengagement without necessitating a vertical displacement.

The tension system of the clamps (axle 11) is located approximately half way in the longitudinal direction between the fore fingers 2 and the rear fingers 2', so as to guarantee an equal division of the tension forces between said two kinds of fingers.

As already described, the clamp is formed of two articulated parts 1, 12. In the case of a twisting disengagement for example, the system works normally and there is a pivoting motion of all the clamp about the axle 13. This self-compensating system is effective thanks to the articulation (axle 14). In the case of the introduction of snow, ice or other external elements, the differences in height are automatically compensated by the possibility for the fore portion of the clamp to pivot about the axle 14 and thereby to constantly maintain the fore fingers 2 and the rear fingers 2' in contact with the respectively fore and rear gripping shapes 35, 35' of the medial shaped portion 3 of the sole of the boot.

In FIGS. 11 to 15, it is shown in more detail an embodiment of the sole of a ski-boot adapted to cooperate with a safety binding according to the invention.

As already described above with reference to FIG. 10, the sole has a shaped portion 3 in its medial part, which comprises on each side two respectively fore gripping formations 35 and rear gripping formations 35'. These gripping formations 35, 35' are more particularly formed by faces which are inclined toward the inside of the sole and upwardly, and make with the plane of the sole an angle $\beta$ of about 30° and $\beta'$ of about 45° (FIGS. 12 and 13). These formations are thus, as described above, adapted to cooperate in service position with the gripping fingers of the lateral clamps. Along the longitudinal axis of the sole, the shaped portion 3 is connected to the fore and rear parts of the sole by a rib 36, 36' having in cross-section (FIGS. 14 and 15) the shape of a V or of a U.

The shaped portion with gripping formations 35, 35' and the binding ribs 36, 36' can be obtained either during manufacture by moulding with the other parts of the sole, or in the form of an element intended to be attached on an existing sole.

In the most known ski bindings, the presence of snow or ice under the sole of the boot may cause an overload on the actuating mechanical system, and thus lead to the necessity of a higher strength to provoke the opening of said binding in case of falls for example. This is of course a drawback which may hinder the commercialization of such a binding for safety reasons. However, with the binding according to the invention, on the one hand it is possible for the skier to close the bindings even in a difficult situation (for example in deep snow), without necessitating previously completly cleaning the bottom surface of the sole of his boot, and on the other hand, even in the presence of a layer snow or ice under this boot, there is now an overload, and thereby now supplementary strength necessary to cause the opening of the binding in case of a fall for example.

We claim:

1. In a security binding of a boot on a ski comprising two lateral clamps displaceably mounted under the action of a resilient member between a closed service position, in which these clamps cooperate with the sole of the boot, and an opened position, links interconnecting the resilient member and the clamps, means pivotally connecting the links to the clamps for relative swinging movement about axes perpendicular to the plane of the ski, and an arm extending from an end of each clamp lengthwise of the ski and pivotally mounted at its end remote from the clamp for swinging movement about an axis perpendicular to the plane of the ski; the improvement comprising means pivotally interconnecting each clamp and its associated said arm for relative swinging movement about an axis perpendicular to the plane of the ski.

2. Binding according to claim 1, in which said arms extend from said clamps rearwardly, and each clamp has at its rear end a shoulder that comes into abutment against the arm carrying it so as to limit the pivoting movement of the clamp toward the outside of said clamp relative to said arm.

3. Binding according to claim 1, in which each clamp comprises a front gripping member and a rear gripping member, said gripping members making with the plane of the ski an angle of 20°–35° for the front member and 40°–50° for the rear member.

4. Binding according to claim 3, in which the inclination of the front gripping member is about 30° and that of the rear gripping member about 45°, to the plane of the ski.

5. Binding according to claim 1, and a longitudinally sliding strip acting between said resilient member and said links, and rods pivotally interconnecting one end of each said link with one end of said strip.

6. Binding according to claim 5, in which said links each comprise a crank member having a slot therein that receives a pin on the associated clamp, said cranks having two stable positions corresponding to the open and closed positions of the clamps.

7. Binding according to claim 1, and heel means having a sole gripping element mounted displaceably under the action of said resilient member between a service position in which said element retains the rear end of the sole of a boot on the ski and an open position, said clamps and said sole gripping element being interconnected to open and close together.

* * * * *